United States Patent [19]

Luborsky et al.

[11] Patent Number: 4,682,486

[45] Date of Patent: Jul. 28, 1987

[54] AMORPHOUS ALLOY TOROIDS

[75] Inventors: Fred Luborsky, Schenectady; Daeyong Lee, both of Scotia, N.Y.

[73] Assignee: The United States of America as represented by the Secretary of the Navy, Washington, D.C.

[21] Appl. No.: 303,339

[22] Filed: Sep. 18, 1981

[51] Int. Cl.[4] ..... B21C 47/00; H01F 7/06

[52] U.S. Cl. ..... 72/148; 29/605

[58] Field of Search ..... 29/605, 609; 72/146, 72/148, 371, 700

[56] References Cited

U.S. PATENT DOCUMENTS

| | | | |
|---|---|---|---|
| 3,566,462 | 3/1971 | Moore | 29/605 |
| 4,053,331 | 10/1977 | Graham et al. | 148/120 |
| 4,053,332 | 10/1977 | Egami et al. | 148/120 |
| 4,053,333 | 10/1977 | Egami et al. | 148/120 |
| 4,116,728 | 9/1978 | Becker et al. | 148/108 |

OTHER PUBLICATIONS

Luborsky et al, "Strain Induced Anistropy in Amorphous Alloys and the Effect of Toroid Diameter on Magnetic Properties", vol. MAG-15, IEEE Transactions Magnetics, p. 1939 (1979).

Luborsky et al, "Amorphous Materials-A New Class of Soft Magnetic Alloys"; Journal of Magnestism and Magnetic Materials, vol. 19, p. 130 (1980).

*Primary Examiner*—E. Michael Combs

*Attorney, Agent, or Firm*—Prithvi C. Lall; Arthur A. McGill; Michael J. McGowan

[57] ABSTRACT

The soft magnetic properties of amorphous alloy toroids is improved by turning under tension an amorphous alloy ribbon onto itself to form a winding having a preselected number of turns such that the radially acting compressive stress is minimized. In one embodiment, the radially acting compressive stress is locally minimized by using such a toroid pole-piece geometry that the windings have as little an area of curvature as is possible. In another embodiment, the radially acting compressive stress is globally minimized by turning the ribbon onto itself such that successive turns of the winding are wrapped with progressively less tension.

1 Claim, 4 Drawing Figures

AMORPHOUS ALLOY TOROIDS

BACKGROUND OF THE INVENTION

This invention is drawn to the field of materials science, and more particularly, to a novel method for improving the soft magnetic properties of amorphous alloy toroids.

Amorphous metallic alloys may be formed by a variety of techniques including melt-quenching a molten stream onto a rapidly cooled substrate, electro-deposition and splat quenching among others. The resulting amorphous alloys may be binary, tertiary, quarternary, etc. compositions having elements typically selected from the group consisting of the transition metals with the metalloids.

A variety of techniques are known for tailoring the soft magnetic properties of such materials. Graham, Jr. et al, U.S. Pat. No. 4,053,331, issued Oct. 11, 1977, incorporated herein by reference, controls the soft magnetic properties of amorphous metallic alloy ribbons by applying elastic tensile loading. Egami et al, U.S. Pat. No. 4,053,332, issued Oct. 11, 1977, incorporated herein by reference, controls the soft magnetic properties of amorphous alloy ribbons by applying elastic tensile loading to a ribbon passed between two rollers to obtain a reduction in thickness. The rolling tends to reduce the unloaded remanence and improve the load versus remanence range sensitivity. Egami et al, U.S. Pat. No. 4,053,333, issued Oct. 11, 1977, incorporated herein by reference, provides a method for enhancing the residual soft magnetic properities of amorphous alloy ribbons which comprises the steps of subjecting an amorphous alloy ribbon to a predetermined tensile stress, heating the stressed ribbon to a predetermined temperature, maintaining the stressed ribbon in the heated state for a predetermined duration, cooling the ribbon after the predetermined duration and removing the stress. Becker et al, U.S. Pat. No. 4,116,728, issued Sept. 26, 1978, incorporated herein by reference, provides a method for tailoring the residual soft magnetic properties of amorphous alloys which comprises the steps of heating an amorphous alloy to a temperature sufficient to relieve stress in the alloy and less than that required to initiate crystallization, and cooling the alloy in the presence of a directed magnetic field.

It has been observed, however, that when the known techniques are applied to amorphous alloys wrapped in a toroidal configuration the soft magnetic properties show marked deterioration. The observed deterioration in soft magnetic properties of amorphous alloy toroids is believed to be the effect of a strain-induced anisotropy which is caused by the winding stresses introduced by the toroidal geometry and which are "frozen-in" by the action of a suitable stress-relief anneal. Reference in this connection may be had to an article entitled "Strain Induced Anisotropy In Amorphous Alloys And The Effect Of Toroid Diameter On Magnetic Properties", appearing in IEEE Transactions Magnetics, Vol. MAG-15, p 1939 (1979), by Luborsky et al and to an article entitled "Amorphous Materials—A New Class of Soft Magnetic Alloys", appearing in Journal of Magnetism and Magnetic Materials, Volume 19, p. 130 (1980), by Luborsky et al both of which are incorporated herein by reference. The former article shows that the soft magnetic properties of amorphous alloy toroids improve with increasing toroid diameter. It is further known that it is desirable to increase the packing fraction of a toroid in order to minimize its volume to provide maximum flux density. Thus, it is desirable to provide a method for improving the soft magnetic properties of amorphous alloy toroids without sacrificing the packing fraction.

SUMMARY OF THE INVENTION

The novel method for improving the soft magnetic properties of amorphous alloy toroids of the present invention comprises the steps of selecting an amorphous alloy material in ribbon form; and turning under tension the ribbon onto itself to form a winding having a preselected number of turns such that the radially acting compressive stress introduced by the turning is minimized, whereby an amorphous alloy toroid having improved soft magnetic properties is provided with a maximized packing fraction.

According to one embodiment of the present invention, successive turns of the amorphous alloy ribbon are wrapped with progessively less tension to globally minimize the radially acting compressive stress arising from the turning of the ribbon onto itself to form a toroid having a preselected number of turns. In this manner, the strain-induced anisotropy that acts to deteriorate the soft magnetic properties of amorphous alloy toroids is substantially overcome.

According to another embodiment of the present invention, the amorphous alloy ribbon is turned onto itself over at least two (2) spacially removed pole pieces to locally minimize radially acting compressive stress; straight regions of the winding are substantially free of radially acting compressive stress. In a particular application, the radius of curvature of the pole-pieces is maximized so that the radially acting compressive stress in the neighborhood of the pole-pieces is minimized. In this manner, the strain-induced anistropy that arises from the turning of the ribbon onto itself to form a toroid and which acts to deteriorate the soft magnetic properties of amorphous alloy toroids is substantially overcome.

Accordingly, it is an object of the present invention to improve the soft magnetic properties of amorphous alloy toroids without sacrificing the packing fraction.

It is a related object of the present invention to improve the soft magnetic properties of amorphous alloy toroids by minimizing the radially acting compressive stress.

It is another related object of the present invention to improve the soft magnetic properties of amorphous alloy toroids by globally minimizing the radially acting compressive stress.

Yet another related object of the present invention is to improve the soft magnetic properties of amorphous alloy toroids by locally minimizing the radially acting compressive stress.

These and other objects and attendant features of the present invention will become apparent from the appended claims, the following detailed description of the preferred embodiments, and from the drawings, wherein like parts are similarly designated throughout, and wherein:

DESCRIPTION OF THE PREFFERRED EMBODIMENTS

Amorphous metallic alloys of the compositions useful in large transformers are remarkably stress sensitive. As discussed in the background of the invention, it has been observed that the soft magnetic properties, such as coercivity and remanence, show marked improvement when an elastic tensile load is applied to a straight strip of amorphous alloy; an opposite effect has been observed when an elastic tensile load is applied to a stress-relieved toroid made of an amorphous alloy material.

Figure 1:
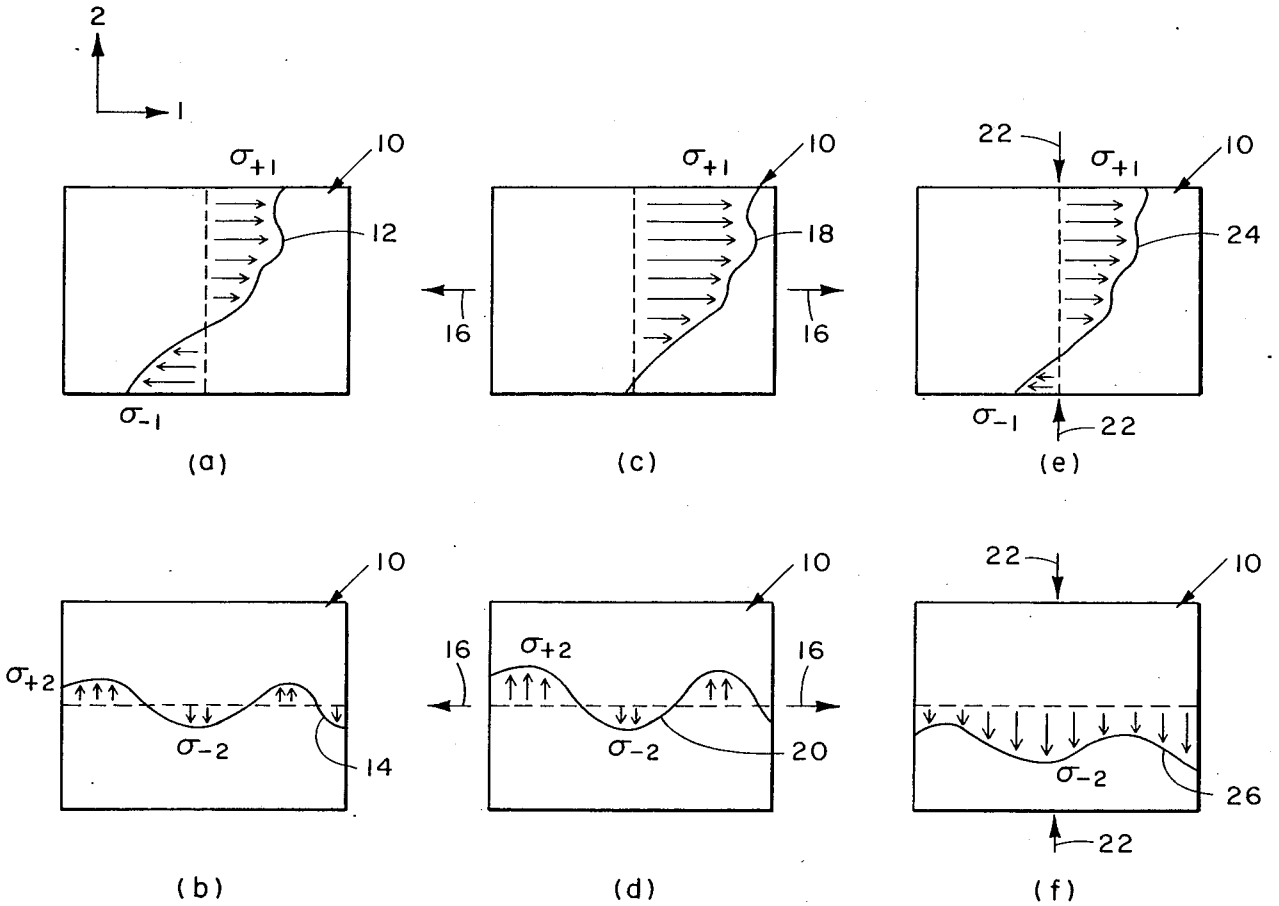
FIG. 1 is a diagram illustrating the residual stress patterns of unloaded, tensilely loaded and compressively loaded as-quenched amorphous alloy ribbons.

Consider now a cross section of an as-quenched amorphous alloy ribbon 10 in FIG. 1, where axes one (1) and two (2) refer to the longitudinal and the through-thickness directions, respectively. As shown in FIGS. 1*a* and 1*b* respectively, complex residual stress patterns 12 and 14 have developed in the as-quenched condition in both longitudinal and through-thickness directions. When an elastic tensile stress 16 is applied to the ribbon 10 in the axial direction, the resulting residual stress patterns 18 and 20 are shown schematically in FIGS. 1*c* and 1*d*, respectively. Longitudinal residual stress becomes predominantly tensile as shown in FIG. 1*c* which helps align magnetic domains so that coercive force decreases, and remanence increases with increasing stress. FIG.1*d* shows that no significant change is expected to take place on through-thickness residual stress in this case.

If, on the other hand, a compressive stress 22 is applied in the through-thickness direction, the longitudinal residual stress 24 would not show marked change but the through-thickness residual stress 26 would change, as shown in FIGS. 1*e* and 1*f*, respectively. Such a residual stress distribution, it is believed, gives rise to a strain-induced anisotropy which results in the observed deterioration in soft magnetic properties of stress relived amorphous alloy toroids.

Figure 2:
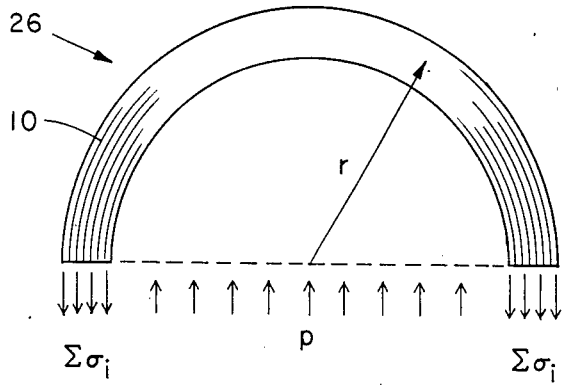
FIG. 2 is a diagram illustrating the state of stress produced in an amorphous alloy toroid.

FIG. 2 shows the state of stress in a toroid, generally designated as 26, where the amorphous ribbon 10 is under an elastic tensile load. If a constant tensile stress, $\sigma$, is applied to the ribbon 10 with a thickness, t, over an average radius, r, of the toroid 26, the balance of forces in the vertical direction can be expressed:

$$2n\sigma t = 2rp, \tag{1}$$

and rearranging terms:

$$p = n\sigma t/r; \tag{2}$$

where n is the number of windings and p is the radially acting compressive stress applied on the inside surface of the toroid. Equation (2) indicates that p increases linearly with n and $\sigma$, thereby producing the effect shown in FIGS. 1*e* and 1*f*.

According to the present invention, the soft magnetic properties of amorphous alloy toroids are improved by turning under tension an amorphous alloy ribbon onto itself to form a toroid having a preselected number of turns such that the radially acting compressive stress is minimized. The number of turns is selected to provide a particular design flux. By minimizing the radially acting compressive stress, the strain-induced anistropy which acts to deteriorate the soft magnetic properties is substantially overcome without sacrificing the packing fraction of the turns.

Figure 3:
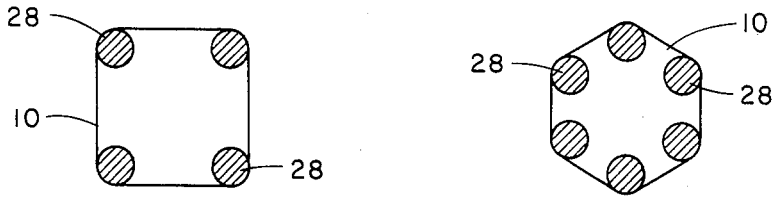
FIG. 3 is a cross-sectional diagram illustrating possible toroid cross-sections to locally minimize radially acting compressive stress according to the present invention.

According to one embodiment of the present invention, the radially acting compressive stress is locally minimized. As can be seen by referring to FIG. 3, which shows two examples of possible toroid cross-sections to locally minimize the radially acting compressive stress, the straight regions of the ribbon 10 remote from the pole-pieces 28, having no curvature, are substantially free of the deletereous effects produced by the radially acting compressive stress. In those regions of the ribbon 10 in the neighborhood of the pole-pieces 28, the radially acting compressive stress is locally minimized by maximizing the area of curvature of the pole-pieces 28 consistent with a particular application. In this manner, the windings of the ribbon 10 have as little an area of curvature as is possible so that the effective volume of amorphous alloy which is under and subject to the radially acting compressive stress is locally minimized. It will be appreciated that although FIG. 3 shows the use of four (4) and six (6) pole-pieces a different number of spatially removed pole-pieces may be utilized to locally minimize the radially acting compressive stress according to the present invention.

Figure 4:
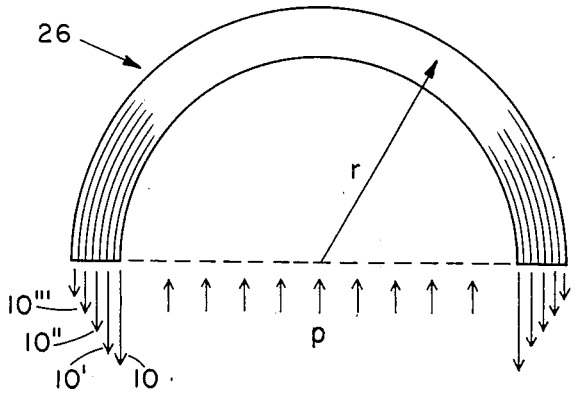
FIG. 4 is a diagram illustrating how the radially acting compressive stress may be globally minimized according to the present invention.

According to another embodiment of the present invention, the deletereous effect on the soft magnetic properties of amorphous alloy toroids is overcome by globally minimizing the radially acting compressive stress. Referring now the FIG. 4, which shows a diagram illustrating how the soft magnetic properties of amorphous alloy toroids can be improved by globally minimizing the radially acting compressive stress, equation (2) can be rewritten as:

$$p = \frac{t \sum_{k=1}^{n} \sigma_k}{r} \tag{3}$$

if each winding is subjected to different stress.

In this embodiment, successive turns 10, 10', 10'', 10''' etc. of the winding are wrapped with progressively decreasing tension over a generally circular pole-piece, not shown. If the first winding has the maximum stress and the stress in the subsequent windings is gradually reduced, the radially acting compressive stress is globally minimized. This may be achieved by any suitable means such as by having a sufficiently high coefficient of friction between adjacent layers of the winding of the amorphous ribbon or by adhesively joining the layers permanently as the ribbon is turned upon itself to form the toroid.

It will be appreciated that the techniques discussed in the background of the invention may advantageously be applied to controllably vary the soft magnetic properties of amorphous magnetic alloy toroids provided according to the novel method of the present invention. For example, the amorphous alloy toroids provided by the novel method of the present invention preferably may be subjected to a stress relief anneal as taught either by U.S. Pat. No. 4,053,333 or U.S. Pat. No. 4,116,728, incorporated herein by reference.

In summary, the soft magnetic properties of amorphous alloy toroids is improved by turning under tension an amorphous alloy ribbon onto itself to form a winding having a preselected number of turns such that the radially acting compressive stress is minimized. The number of turns is selected to handle a particular design flux. In one embodiment, the radially acting compressive stress is locally minimized by using such a toroid pole-piece geometry that the windings have as little an area of curvature as is possible. In another embodiment, the radially acting compressive stress is globally minimized by turning the ribbon onto itself such that successive turns of the winding are wrapped with progessively less tension.

What is claimed is:

1. A method for providing an amorphous alloy non-circular toroid having improved soft magnetic properties comprising the steps of:

obtaining an amorphous alloy in a ribbon form; and spirally winding said ribbon under tension to form a winding having a preselected number of turns by wrapping said ribbon in sucessive turns over at least two (2) spatially removed pole pieces with progressively less tension in said turns to minimize radially acting compressive stress over the volume of the toroid while maximizing the curvature of said pole pieces; to minimize radially acting compressive stress in portions of the turns surrounding the pole pieces and thereby provide an amorphous alloy non-circular toroid having improved soft magnetic properties with a maximized packing fraction.

* * * * *